United States Patent [19]

Jones et al.

[11] 4,053,786

[45] Oct. 11, 1977

[54] TRANSDUCER OUT OF RANGE PROTECTION FOR A STEAM TURBINE GENERATOR SYSTEM

[75] Inventors: Donald J. Jones; Gary W. Berkebile, both of Pittsburgh, Pa.

[73] Assignee: Westinghouse Electric Corporation, Pittsburgh, Pa.

[21] Appl. No.: 427,429

[22] Filed: Dec. 21, 1973

[51] Int. Cl.[2] ..... F01K 13/02

[52] U.S. Cl. ..... 290/52; 290/40 R; 60/663; 60/679

[58] Field of Search ..... 60/646, 652, 657, 660, 60/663, 679; 290/4, 40, 2, 52

[56] References Cited

U.S. PATENT DOCUMENTS

| | | | |
|---|---|---|---|
| 3,097,490 | 7/1963 | Callan et al. | 60/663 X |
| 3,511,051 | 5/1970 | Mitchell | 60/663 |

*Primary Examiner*—Allen M. Ostrager
*Attorney, Agent, or Firm*—H.W. Patterson

[57] ABSTRACT

Unnecessary fast valving action for load loss protection in a steam turbine generator system induced by partial transducer failure is minimized by the disclosedmethods and apparatus. Upon the occurrence of a mismatch between reheat pressure and electrical output, the interceptor valve is closed momentarily to interrupt the flow of steam to the low-pressure turbine and prevent overspeed. The valve cannot be closed again for a predetermined interval. If the mismatch is not corrected by the one fast valving action, a transducer has failed and further closing of the interceptor valve, except for a full load loss, is precluded until corrective action is taken. The faulty transducer is singled-out by comparing one of the transducer signals with the impulse pressure which is also an indication of the actual operating level of the turbine.

16 Claims, 3 Drawing Figures

TRANSDUCER OUT OF RANGE PROTECTION FOR A STEAM TURBINE GENERATOR SYSTEM

BACKGROUND OF THE INVENTION

1. Field of the Invention

This invention relates to control systems for steam turbine generators, and more specifically, the methods and apparatus for precluding unnecessary tripping of the turbine in the event of transducer failure.

2. Prior Art

In a steam turbine generator system the turbine is normally maintained at constant speed and steam flow is varied to adjust the torque required to meet the electrical load imposed on the generator. This type of control is provided by the main control system which varies the flow of steam to the high-pressure turbine, and in some instances to the low-pressure turbine, to meet the load demand. The main control system is designed to accommodate for normal changes in load demand and to smoothly adjust the turbine operating conditions to the new demand. However, if the electrical load is suddenly lost or reduced significantly, a commensurate reduction must be made in the flow of steam through the turbine or the turbine will overspeed, possibly causing turbine damage. The main control system does not possess sufficiently rapid response characteristics to accommodate for such sharp variations in load demand, especially in the newer high power to inertia ratio turbine systems.

In addition to the main control system, the turbine generator combination is also provided with a protective or back-up control system which accommodates for abnormal changes in demand or failures in the main control system. A particularly effective protective system for dealing with load losses is disclosed in U.S. Pat. No. 3,643,437 (Birnbaum, et al.), which is assigned to the same assignee as this invention. That system relies on the fact that the power provided by the steam turbines, i.e. the input to the electrical generator, is approximately linearly related to the low-pressure turbine inlet steam pressure. Since most modern steam turbines are provided with reheat apparatus between the high-pressure and low-pressure turbines, this pressure is more commonly referred to as the reheat pressure. It follows then that, a comparison of the generator input and output can be made by comparing the reheat pressure with the electrical power provided by the generator. If a partial or total load loss of load occurs, the power provided by the generator will drop rapidly while the reheat pressure remains relatively constant, i.e., the power provided by the steam turbine to the electrical generator exceeds the electrical power generated.

In accordance with Birnbaum system, the occurrence of a predetermined relationship between the reheat pressure and electrical output of the generator is interpreted as an indication of a partial load loss, and in response thereto the interceptor valve between the reheat apparatus and the low-pressure turbine is closed rapidly. This terminates the flow of steam to the low-pressure turbine while steam continues to be supplied to the high-pressure turbine. If this condition were permitted to continue, the relief valves on the reheat apparatus would open. However, according to the patent, the interceptor valve is only held closed momentarily, such as from 0.6 to 1.2 seconds, during which time additional load must be connected to the electrical generator. If the predetermined relationship between the reheat pressure and the electrical output still exists when the interceptor valve is reopened, the interceptor valve will again close and will continue to cycle until the condition is corrected or the operator takes other appropriate action.

Birnbaum utilizes the same relationship between the reheat pressure and the electrical output together with the additional indication that the main circuit breakers on the electrical generator are open, to detect a full load loss. Under these conditions both the governor valve, which controls the flow of steam to the high-pressure turbine, and the interceptor valve are closed to terminate all steam flow to the turbines. Resetting of the circuit breakers returns control to the main control system when the speed of the turbine drops below a preset value. If the breakers do not re-set, the governor valve and the interceptor valve will cycle until the turbine trips or corrective action is taken by the operator. Thus this system effectively and quickly responds to full load loss, yet also responds appropriately and without over-reaction to partial load losses.

The effective operation of any control system is the result of proper operation of, and interaction between, the various component parts of the system. Essential elements of a turbine system are the transducers which provide the inputs to the control system representative of the operating condition of various portions of the turbine system. Among these are the reheat pressure transducer and the wattmeter which provides a representation of the electrical output or load on the generator. It is evident that should one of these transducers fail, the failure could be detected by the protective system of Birnbaum as a partial load loss and the steam flow to the turbine could be interrupted repeatedly until the turbine was tripped. Such an unnecessary shutdown of the turbine is very costly.

Birnbaum attempts to provide for such a failure by preventing fast valving action when either the reheat pressure or the load signal is above the maximum or below the minimum value attainable in normal operation of the turbine. However, this does not provide for partial failure of a transducer such as when a pressure transducer shifts range. For instance, on the Hagen Model 109 Pressure Transducer used by the assignee of this invention to provide an input representative of the reheat pressure, it has been found that failure of a particular capacitor can cause the device to shift from one to five volts full range to two and one-half to five volts. Under these conditions the Birnbaum system would detect a mismatch indicative of a partial load loss, and since the transducer signal is not above the maximum or below the minimum, the interceptor valve would close. Since the mismatch would not be corrected by the fast valving, the interceptor valve would continue to cycle.

Similarly, the wattmeter used to measure the three-phase electrical power provided by the generator can fail such that an erroneous signal between the minimum and maximum load signal is provided to the control system. For instance, the Hall wattmeter commonly used as the load transducer, utilizes the three currents and two of the voltages to determine the power delivered to the three-phase system. If one of the current signals is lost, such as by the blowing of a fuse, the power signal generated by the wattmeter will be only two-thirds of the actual power delivered. Again this is interpreted by the Birnbaum system as a partial load loss, causing continued cycling of the interceptor valve and eventual tripping of the turbine system.

In view of the foregoing, it is the primary object of this invention to provide more reliable steam turbine generator performance.

It is also an object of the invention to provide improved protection for the turbine system.

It is another object of the invention to preclude unnecessary tripping of the turbine system.

SUMMARY OF THE INVENTION

The present invention is operative to prevent continued unnecessary interruptions of steam flow to the turbines in the event of partial transducer failure, yet it provides rapid effective response to true load losses.

In the present day large steam turbines, it has been determined that the build-up of steam pressure in the reheater resulting from the interruption of the flow to the low-pressure turbine while steam is still being applied to the high-pressure turbine can be tolerated for an interval of sufficient duration to permit the correction of the partial load loss. It follows then that in the case of a true partial load loss, only one closing of the interceptor valve is required to correct the situation. It has also been determined that limited closing of the interceptor valve when in fact no load has been lost will not unduly perturb the turbine system.

Thus according to the invention, upon the occurrence of a predetermined relationship between the reheat pressure and the electrical load indicative of a partial load loss, the interceptor valve is closed to immediately terminate steam flow to the low-pressure turbine. Interruption of steam flow to the low-pressure turbine reduces the torque developed by the turbines, thereby preventing overspeed if in fact a partial load loss has occurred. The interceptor valve remains closed sufficiently long enough to permit correction of the partial load loss, but not long enough to trip the turbine. The selection of this interval must take into account the characteristics of the particular installation to which the invention is applied, however, in the exemplary system, an interval of 0.3 to 1.0 seconds is provided.

Since a true partial load loss would be corrected during this interval, the proper relationship between the reheat pressure and the electrical output will rapidly be reestablished upon the reopening of interceptor valve. If the mismatch is not eliminated by this corrective action, it is due to a faulty transducer. Under these conditions further closing of the interceptor valve is prevented until corrective action is taken by the operator. More than one operation of the interceptor valve could be provided for, however, as long as a true partial load loss can be corrected within the interval that the valve may remain closed, one closing is sufficient. Once interceptor valve action has been taken to correct for load loss, further closing of the interceptor valve is prevented for a preset interval such as ten seconds.

Preferably, the mismatch between reheat pressure and electrical output must persist for an interval which is significantly longer than the cycle time of the interceptor valve such that the reheat pressure may have time to return to normal after the interceptor valve is reopened. In the exemplary embodiment of the invention, this interval was selected as two seconds while it will be recalled the interceptor valve remained closed for 0.3 to 1.0 seconds. Since recycling of the interceptor valve is permitted only once every ten seconds, the continuous mismatch for the additional one second after steam flow is reestablished and before the permanent hold on reclosing the interceptor valve is generated, in the case of a transducer partial failure does not effect turbine operation.

In the preferred embodiment of the invention, separate comparsions of transducer signals are made for initiating closing of the interceptor valve and for preventing additional closing in the case of a transducer failure. By providing a narrower deadband for the comparison utilized to block further closing of the interceptor valve, the faulty transducer can be repaired or replaced and brought back on line without triggering a closing of the interceptor valve. In the exemplary embodiment of the invention, fast valving is initiated by a 20% mixmatch between reheat pressure and electrical load while the signals must be within 17% to permit further closing of the interceptor valve. It is also preferred, although not necessary, that in the case of a failure of either the reheat pressure transducer or the wattmeter, one of these signals be compared to a third signal which is also approximately linearly related to the load demand in order that the faulty transducer may be singled out. This third signal may be provided by the impulse pressure transducer which generates a signal representative of the pressure in the inlet chamber of the high-pressure turbine.

The invention embraces both the method and apparatus for carrying out the invention.

BRIEF DESCRIPTION OF THE DRAWINGS

An understanding of the invention can be gained from the following description taken in conjunction with the accompanying drawings, in which.

DESCRIPTION OF THE PREFERRED EMBODIMENT

Figure 1:
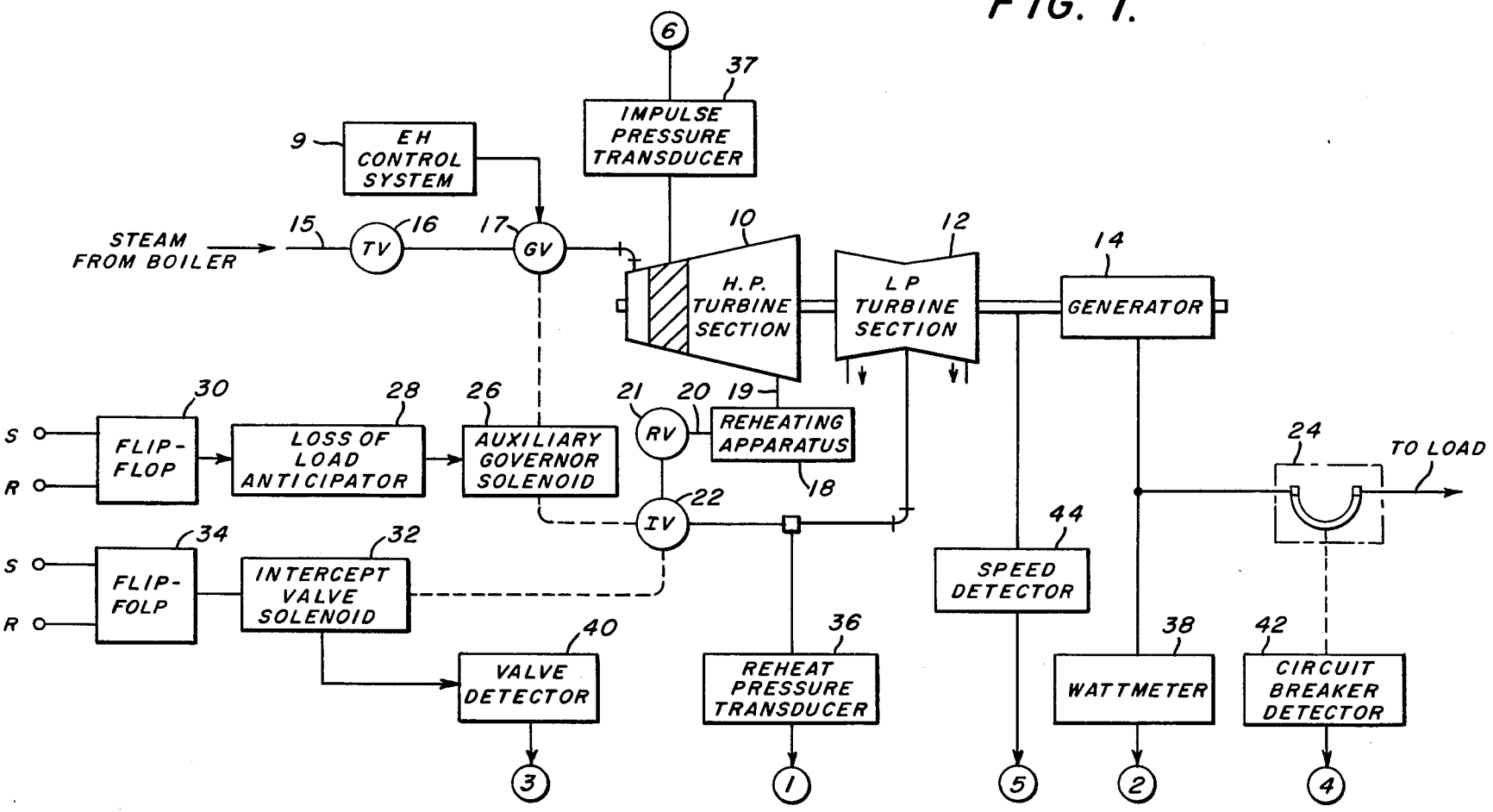
FIG. 1 is a schematic diagram of a steam turbine generator system incorporating the present invention.

The invention will be described as applied to the turbine generator system disclosed in the Birnbaum patent with like parts given like reference numerals. Referring to FIG. 1, there is shown a turbine generator having a high-pressure (H.P.) turbine unit 10, and a low-pressure (L.P.) turbine unit 12 connected in tandem and jointly driving an electric generator 14. Additional turbine stages may also be provided, such as additional high- and low-pressure stages and one or more intermediate pressure turbine stages located between the high- and low-pressure stages.

In the preferred embodiment of the invention, the turbines are under the control of a main turbine control system and of the type referred to by those skilled in the art as an "electrohydraulic" or EH turbine control. However, other more traditional turbine control systems, either mechanical or hydraulic, can be utilized with the present invention. An analog form of such an electrohydraulic system (AEH) is described in a paper entitled "Electro Hydraulic Control for Improved Availablility and Operation of Large Steam Turbines," presented to the ASMEE-IEEE National Power Conference, Sept. 19–23, 1965. A digital EH system (DEH), which utilizes a programmed digital computer, is described in patent application Ser. No. 247,877, entitled "System and Method for Starting, Synchronizing and Operating A Steam Turbine with Digital Computer Control," filed by T. Giras, et al., on Apr. 26, 1972 and assigned to the same assignee as this invention. Hereinafter, the term EH controller will include both the AEH and the DEH-type control systems.

High-pressure motive steam from any suitable supply, for example a nuclear reactor (not shown) is admitted to the H.P. turbine unit 10 by a conduit 15 having interposed therein the usual throttle valve 16 and governor valve 17, both of which can comprise a plurality of valve structures. The governor valve 17 is controlled under normal operating conditions by the EH control system 9. After partial expansion in the high-pressure turbine unit 10, the steam is directed to suitable reheating apparatus 18 by a conduit 19 and the reheated steam is then directed to the low pressure turbine unit 12 by a conduit 20 for further expansion. The conduit 20 has a conventional reheat stop valve 21 therein and an interceptor valve 22 interposed in the conduit 20 downstream of the reheat stop valve 21.

In normal operation, as thus far described, the throttle valve 16, the reheat stop valve 21, and the interceptor valve 22 are fully opened, and the governor valve 17 is regulated by the EH controller or other suitable control means to the degree of opening required to admit high-pressure steam to the turbine units at a rate effective to satisfy the load requirements of the generator 14. The electrical output from the generator 14 passes to the load through a suitable circuit breaker 24. Although the output from the generator is shown as single phase the generator can provide three-phase or other forms of output power in which case a corresponding number of circuit breakers are required.

The governor valve 17 and the interceptor valve 22 are opened and closed by operation of an auxiliary governor solenoid 26, which in turn is energized by loss of load anticipator 28. The latter is set or reset by a flip-flop 30. Control of the governor valve 17 by the load anticipator 28 is in addition to the control provided by the EH controller 9. More particularly, as will be described in detail subsequently, the anticipator 28 supersedes control of valve 17 if certain speed and power conditions exist. Additionally, the interceptor valve 22 may be opened and closed by operation of interceptor valve solenoid 32 which is set and reset by a flip-flop 34 in a manner described subsequently.

A pressure transducer 36 senses the pressure of the steam along the conduit 20 in the path between the valve 22 and the inlet to the low-pressure turbine stage 12, i.e., the reheat pressure. A wattmeter 38 or other suitable power-measuring device is coupled with the output of generator 14 to provide a signal representing the electrical power provided to the load by generator 14. A signal is provided by a valve detector to indicate the state of the interceptor valve 22, i.e., whether the interceptor valve 22 is opened or closed. The circuit breaker detector 42 similarly provides information relative to the state of the circuit breaker 24. Speed detector 44 provides a signal or representation indicative of the rotational velocity of the turbine generator shaft. Another pressure transducer 37 senses the impulse pressure in the inlet chamber of the high-pressure turbine stage 10. All of the above-described transducers may be of any suitable design well known in the art.

Figure 2:
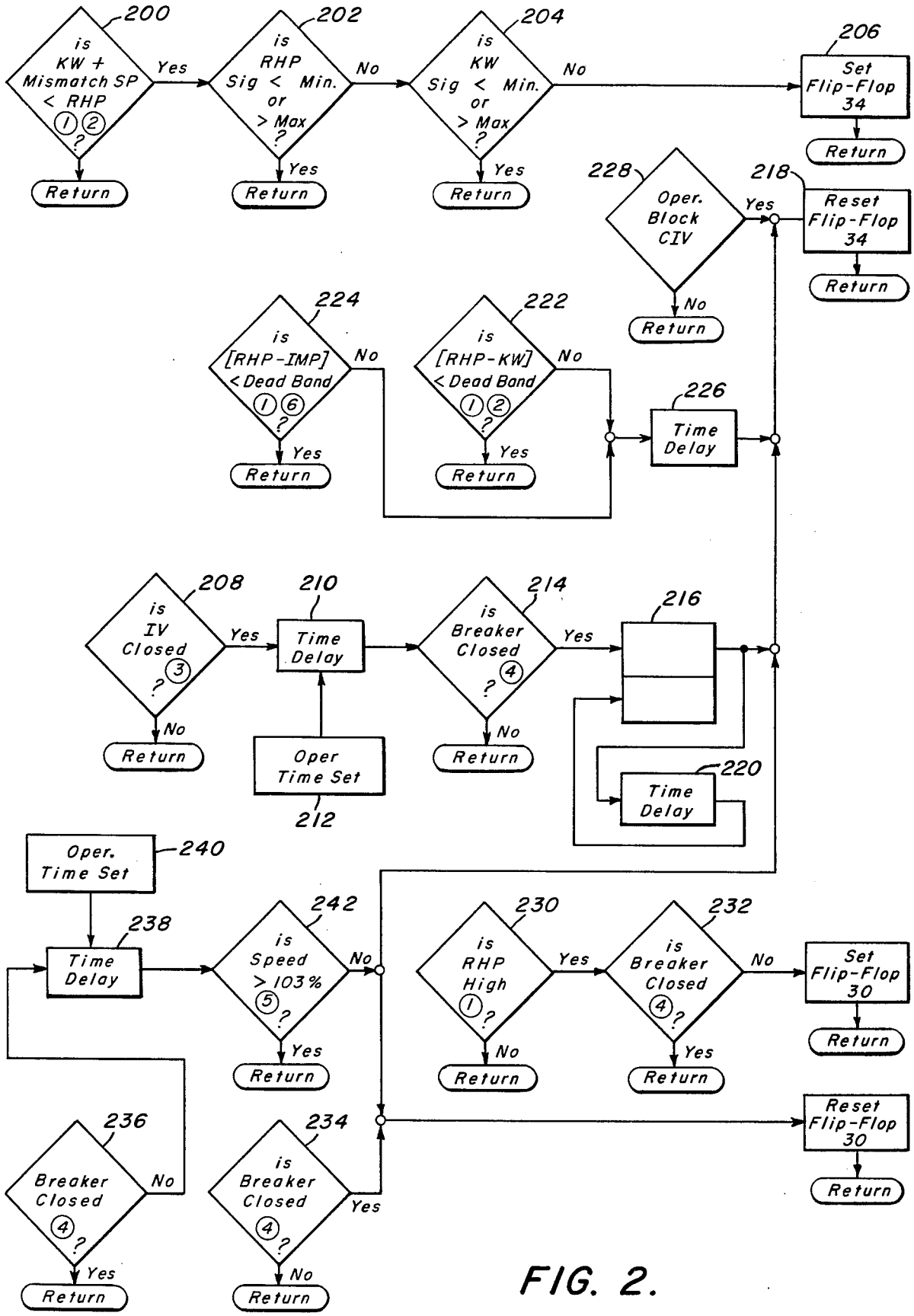
FIG. 2 is a flow chart which functionally illustrates the invention.

With reference to FIG. 2, there is shown therein a logic flow diagram which is illustrative of the functioning of the system in accordance with the present invention. Outputs from the various transducers monitored at each block in the flow diagram are indicated by encircled numbers. Thus, in FIG. 1, the output from reheat pressure transducers 36 is indicated by an encircled 1, wattmeter 38 by 2, valve detector 40 by 3, circuit breaker detector 42 by 4, speed detector 44 by 5, and impulse pressure detector 37 by 6. The RETURN symbol used extensively in FIG. 2 indicates that no further decisions are to be made along the flow design and that the sequence is to start again.

A loss of load protection system is included in FIG. 2. At block 200, the electrical output of the generator 14 as sensed by the wattmeter 38 is compared with reheat pressure as sensed by the pressure transducer 36. If the reheat pressure exceeds the electrical output by an amount equal to the mismatch set point, which in the preferred embodiment is 20%, checks are made at blocks 202 and 204 to determine if the reheat pressure and wattmeter signals are within the permissible limits discussed above, and if so the flip-flop 34 is set at block 206. The setting of flip-flop 34 energizes interceptor valve solenoid 32 in FIG. 1 to close the interceptor valve 22. As discussed previously, closure of the interceptor valve 22 substantially terminates flow of steam through the low-pressure turbine 12 thereby preventing the turbine from exceeding its maximum permitted rotational velocity.

As indicated at block 208, the signal provided by the valve detector 40 is sensed to determine the status of the interceptor valve 22. If the valve is closed, a time delay is initiated in block 210 which may be varied in the preferred embodiment from 0.3 to 1.0 seconds by the operator at block 212. At the end of the interval a check is made in block 214 to determine if the breaker is closed as indicated by circuit breaker detector 42. If the breaker is open, indicating a full load loss, another portion of the control system to be described below, becomes operative. If, however, the breaker is closed, a flip-flop 216 is set. The setting of flip-flop 216 is operative to reset flip-flop 34 in block 218, thereby deenergizing the interceptor valve solenoid 32 and opening the interceptor valve 22. During the time that the interceptor valve 22 is closed, appropriate action is taken to add additional load to stabilize the system if, in fact, a loss of load triggered the closing of the interceptor valve.

As long as the flip-flop 216 remains set, the flip-flop 34 is held in reset at block 218 and cannot be set again to reclose the interceptor valve. However, the setting of flip-flop 216 also initiates a time delay at block 220. In the preferred embodiment this delay is ten seconds, at the end of which the flip-flop 216 is reset to remove the reset signal from flip-flop 34. Thus when closing of the interceptor valve is initiated by a partial load loss, the valve closes for 0.3 to 1.0 seconds and then reopens and cannot be reclosed for ten seconds.

As indicated at blocks 222 and 224 respectively, the reheat pressure is compared with the electrical output and the impulse pressure supplied by pressure transducer 37. If either of these pairs of signals do not agree within 17% in the preferred embodiment, a time delay of preferably two seconds is intiated at block 226. At the completion of the time delay, and as long as the difference between the reheat pressure and either the electrical output or the impulse pressure is not within the 17% deadband, the flip-flop 34 is held in the reset state at block 206.

Thus if a mismatch occurs as detected at block 200, flip-flop 34 is set to close the interceptor valve; after a time delay of 0.3 to 1.0 seconds, the flip-flop 34 is reset by flip-flop 316 and the valve is reopened. If the mismatch was caused by a partial load loss, the load will be added during this interval so that the mismatch will be corrected. If by the end of two seconds the mismatch still exists, it is the result of a failure of either the reheat pressure transducer or the wattmeter and the flip-flop 34 is held in the reset state to prevent further closing of the interceptor valve.

The operator may eliminate protection against partial load losses by appropriate switch action at block 228 which also holds flip-flop 34 in the reset state.

Protection against full load loss is provided in the lower portion of the flow diagram. If the reheat pressure is high at block 230 and the circuit breaker is open at block 232 the flip-flop 30 is set which causes the loss of load anticipator 28 to energize the auxiliary governor solenoid 26. In this manner, the governor valve 17 and the interceptor valve 22 are both closed thereby stopping all flow of stream to both the high-pressure and low-pressure turbines to rapidly reduce the torque generated.

As indicated at block 234, the flip-flop 30 is held in the reset state to block action by the loss of load anticipator whenever the breaker is closed as sensed by the circuit breaker detector 42. Hence, the loss of load anticapator 28 can only be brought into play in the event of a full loss of load. Upon the occurrence of a full load, the open circuit breaker is detected at block 236 and after a time delay as indicated at block 238 which may be varied from 1 to 10 seconds by the operator as indicated in block 240, a check is made in block 242 to determine if the speed as sensed by the speed detector 44 is below 103%. If so, the flip-flop 30 is reset to return control to the EH system. The flip-flop 34 is also reset at this time.

Figure 3:
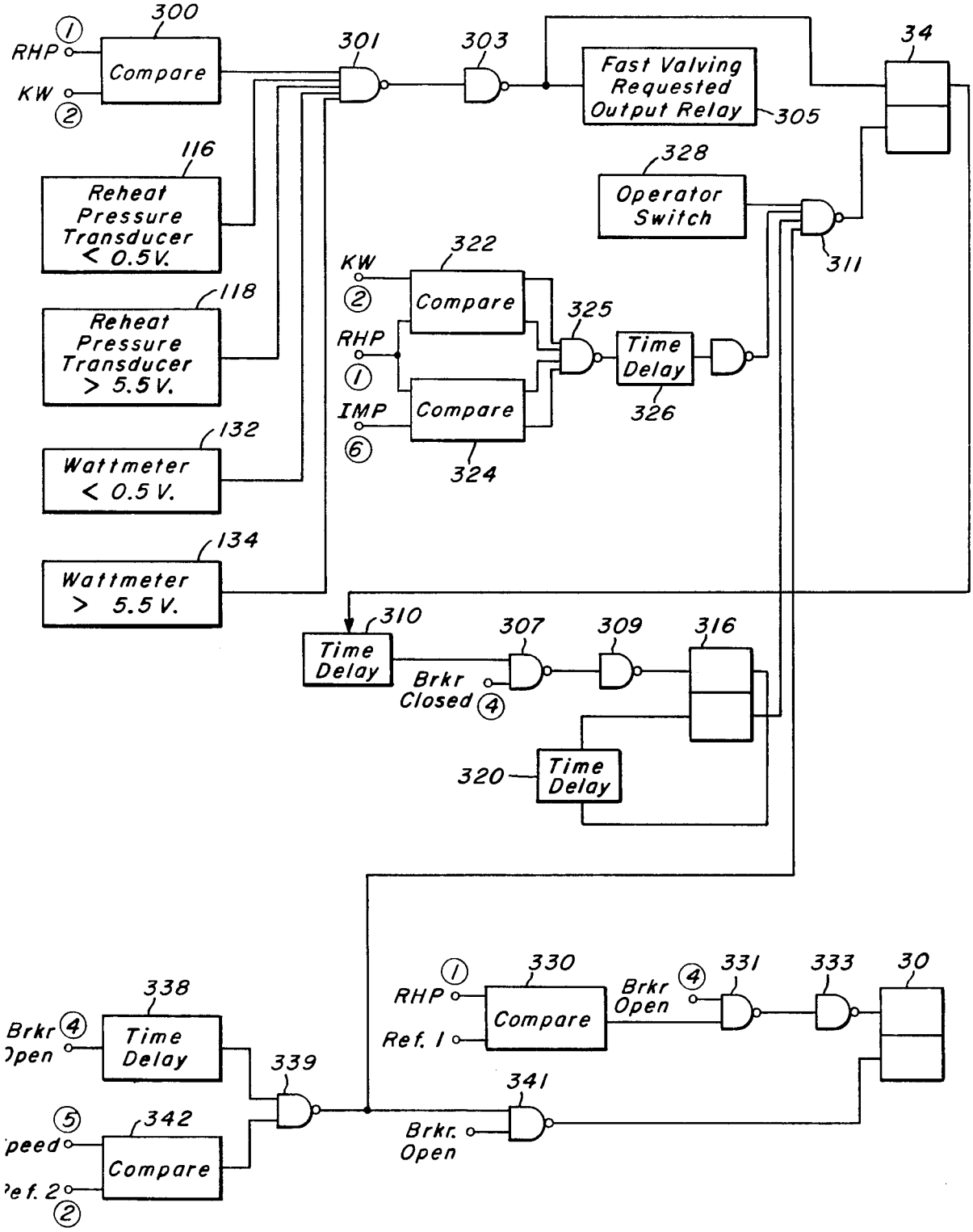
FIG. 3 is a schematic diagram of wired digital logic circuitry which operates in accordance with the flow chart of FIG. 2.

The flow chart of FIG. 2 may be embodied in wired digital logic circuitry such as that shown in FIG. 3 or it can be embodied in the form of a computer program and utilized by a digital computer system, such as the DEH control system referred to above or the plant computer control system disclosed in the Birnbaum patent also referred to above. The techniques for producing a computer program from the flow chart of FIG. 2 are well known.

The circuit of FIG. 3 utilizes NAND logic. The reheat pressure signal (RHP) and electrical load signal (KW) are compared in a comparator 300 which generates no output unless the reheat pressure exceeds the kilowatt signal by 20%. The signal from the comparator is applied to a NAND gate 301. Also applied to the gate 301 are signals from the integrity checking circuit of FIG. 3 of the Birnbaum patent. As long as the levels of the reheat pressure signal and the kilowatt signal are between the maximums and minimums attainable during turbine operation, gate 301 will be enabled to set flip-flop 34 through inverter 303 whenever the reheat pressure exceeds the kilowatt signal by 20%. This also energizes the fast valving requested output relay 305 which activates an alarm to indicate this condition to the operator.

Setting of flip-flop 34 initiates closing of the interceptor valve 22 as discussed above and activates a time delay circuit 310. After a delay of 0.3 to 1.0 seconds as selected, flip-flop 316 is set through gate 307 and inverter 309 if the circuit breaker 24 is closed as indicated by detector 42. Setting of flip-flop 316 disables a gate 311 which resets flip-flop 34 to reopen the interceptor valve. The reset signal continues to be applied to flip-flop 34 to prevent reclosing of the interceptor valve as long as the flip-flop 316 remains set. However, setting of flip-flop 316 activates time delay circuit 320 and after 10 seconds flip-flop 316 is reset which removes the reset signal from flip-flop 34. The operator may selectively prevent closing of the interceptor valve except for a full load loss as discussed below, by activating a switch 328 which holds flip-flop 34 in the reset state through gate 311.

The reheat pressure signal is also continuously compared with the kilowatt signal and the impulse pressure signal in comparators 322 and 324 respectively. These are three state comparators which generate signals at each of two outputs as long as the input signals remain within 17% of each other. If a mismatch greater than 17% occurs one of the output signals will go to zero to activate time delay circuit 326 through gate 325. After a two second interval, delay circuit 326 will generate a signal which will reset flip-flop 34 through inverter 327 and gate 311. Flip-flop 34 will be held in the reset state to prevent reclosing of the interceptor valve as long as a 17% mismatch remains between the reheat pressure signal and either the kilowatt signal or the impulse pressure signals. Since a true partial load failure is corrected by one closing of the interceptor valve this condition is indicative of a transducer failure. The faulty transducer can be singled out by monitoring the outputs of the comparators 322 and 324.

If the turbine is operating above a certain level, as determined by comparing the reheat pressure (RHP) with a reference voltage REF.1 in comparator 330, and the main breaker 24 opens, a full load loss has occurred and flip-flop 30 is set through gate 331 and inverter 333. This activates load loss anticipator 28 which operates the auxiliary governor solenoid to terminate flow to both the high-pressure and low-pressure turbines through closing of the governor valve 17 and the interceptor valve 22.

Flip-flop 30 is prevented from actuating the load loss anticipator except when the breaker is open as indicated by the breaker open signal applied to gate 341 which holds flip-flop 30 in the reset state. However, when the breaker opens to set flip-flop 30, a time delay is initiated by time delay circuit 338. At the conclusion of a 1 to 10 second interval as selected, the flip-flop 30 is reset to disable the load loss anticapitor through gates 339 and 341 as long as the speed of the turbine is below a reference speed such as 103% which is determined by comparing the speed signal generated by the speed detector 44 with a reference signal REF.2.

The foregoing description is meant to be illustrative only, and the full breadth and scope of the invention is set forth in the following claims.

We claim as our invention:

1. A turbine system comprising:

a turbine having at least one high-pressure stage and at least one low-pressure stage, an electrical generator driven by said turbine for supplying electrical power to a load, means responsive to a predetermined mismatch between the steam pressure sensed at the inlet to the low-pressure turbine stage and a representation of the electrical output of the generator for interrupting the flow of steam to at least part of the turbine for a predetermined interval of sufficient duration to permit correction of a partial load loss represented by said predetermined mismatch, and means responsive to a continued mismatch between the steam pressure sensed at the inlet of the low-pressure turbine and the representation of the electrical output of the generator after steam flow to the turbine has been reestablished for preventing continued interrupting of said steam flow.

2. The turbine system of claim 1:

wherein said means for interrupting the flow of steam to the turbine interrupts flow to the low-pressure turbine, and wherein the means for preventing the continued interruption of the steam flow to the low-pressure turbine includes means for delaying the determination of a continuing mismatch at least unitl the system has stabilized after reestablishment of the steam flow, and means for preventing another interruption of the steam flow in the interim.

3. The turbine system of claim 2 wherein the means for preventing further interruptions of the steam flow is operative only so long as said mismatch continues.

4. The turbine system of claim 2 including means responsive to a full load loss and operative to interrupt the flow of stream to both the high-pressure and low-pressure stages of the turbine regardless of a continuing mismatch between the steam pressure sensed at the inlet of the low-pressure turbine stage and the representative of the electrical output.

5. The turbine system of claim 1 wherein the means responsive to a continued mismatch for preventing further interruption of steam flow is responsive to a mismatch which is smaller than said predetermined mismatch.

6. A control system for a steam turbine combination including at least one high-pressure turbine, a control valve for controlling the flow of steam to said high-pressure turbine, a reheater for adding thermal energy to the steam discharged by the high-pressure turbine, at least one low-pressure turbine, an interceptor valve for controlling the flow of reheated steam from the reheater to the low-pressure turbine, and an electrical generator driven by the high- and low-pressure turbines for delivering electrical power to a load, said control system including:

main control means for positioning the control valve and the interceptor valve to match the flow of steam through the turbine with the electrical load, means for sensing the pressure of the steam applied to the inlet of the low-pressure turbine, means for sensing the electrical output power delivered to the load by the generator, means for generating a representation of the ratio between said sensed input pressure and said output power, means for closing the interceptor valve for a predetermined interval of sufficient duration to permit correction of a partial load loss when said ratio exceeds a predetermined amount, and means for preventing continued closing of the interceptor valve when said ratio exceeds a preselected amount for a preselected interval longer in duration than that required to correct a partial load loss.

7. The control system of claim 6 including means responsive to the operation of the interceptor valve for preventing a second closing thereof for a preset interval which is at least as long as said preselected interval.

8. The control system of claim 7 wherein said preselected interval is longer in duration than the predetermined interval that the interceptor valve remains closed by an amount sufficient to permit the system to stabilize following the reopening of the interceptor valve.

9. The control system of claim 8 wherein the predetermined interval is about one second and the preselected interval is about 2 seconds.

10. The control system of claim 6 wherein said preselected ratio is less than said predetermined ratio.

11. The control system of claim 10 wherein said predetermined ratio is about 20%.

12. The control system of claim 6 including means for generating a representation of the ratio of one of the sensed signals to the pressure at the inlet to the high-pressure turbine and for generating a signal when this ratio exceeds said preselected ratio.

13. A method for controlling a turbine system comprising:

at least one high-pressure turbine, at least one low-pressure turbine, and an electrical generator driven by the turbines for supplying electric power to a load, said method comprising the steps of:

generating a signal representative of pressure of the steam at the inlet of the low-pressure turbine, generating a signal representative of the output of the generator, generating a signal representative of the ratio of the steam pressure to the output power, terminating the flow of stream to the low-pressure turbine for an interval of sufficient duration to permit correction of a partial load loss but not of sufficiently long duration to cause the turbine to trip when the ratio of the pressure signal to output signal exceeds a predetermined amount, and preventing repeated termination of the flow of steam to the low-pressure turbine when the ratio of the pressure signal to the output signal remains above a preselected amount following the reestablishment of steam flow to the low-pressure turbine

14. The method of claim 13 wherein the step of preventing repeated termination of the flow of steam to the low-pressure turbine includes the steps of:

preventing a second termination of steam flow to the low-pressure turbine for a preset interval, checking the ratio of the pressure signal to the output signal during said preset interval, and preventing another termination of the steam flow to the low-pressure turbine so long as said ratio remains above the preselected amount.

15. The method of claim 14 including the additional step of terminating the flow of steam at least momentarily to both the high-pressure turbine and the low-pressure turbine upon the occurrence of a full load loss regardless of how long the ratio of said pressure signal to the output signal remains above said preselected amount.

16. The method of claim 14 wherein said preselected ratio is less than said predetermined ratio.

* * * * *